US010472821B2

(12) United States Patent
Castonguay et al.

(10) Patent No.: US 10,472,821 B2
(45) **Date of Patent: *Nov. 12, 2019**

(54) WALL WITH DECORATIVE FACING

(71) Applicant: LES MATERIAUX DE CONSTRUCTION OLDCASTLE CANADA, INC., St-John (CA)

(72) Inventors: Bertin Castonguay, Magog (CA); Robert Daoust, Boucherville (CA)

(73) Assignee: LES MATERIAUX DE CONSTRUCTION OLDCASTLE CANADA, INC, St-John (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/792,102

(22) Filed: Oct. 24, 2017

(65) Prior Publication Data

US 2018/0044915 A1 Feb. 15, 2018

Related U.S. Application Data

(63) Continuation of application No. 15/267,719, filed on Sep. 16, 2016, now Pat. No. 9,803,359, which is a (Continued)

(51) Int. Cl.
*E04B 2/30* (2006.01)
*E04B 2/34* (2006.01)

(Continued)

(52) U.S. Cl.
CPC ..... *E04B 2/30* (2013.01); *E04B 2/34* (2013.01); *E04B 2/46* (2013.01); *E04B 2/8641* (2013.01);

(Continued)

(58) Field of Classification Search
CPC . E04B 2/30; E04B 2/34; E04B 2/8641; E04B 2/46; E04B 2002/0247;

(Continued)

(56) References Cited

U.S. PATENT DOCUMENTS 701,150 A * 5/1902 Chrisford ..... E04B 2/30 52/565
738,643 A 9/1903 Van Camp (Continued)

FOREIGN PATENT DOCUMENTS

CA 2258637 A1 8/1999
CA 2367664 A1 11/2000

(Continued)

OTHER PUBLICATIONS

U.S. Appl. No. 15/625,254, Final Office Action dated Apr. 2, 2018.

(Continued)

*Primary Examiner* — Patrick J Maestri
*Assistant Examiner* — Joseph J. Sadlon
(74) *Attorney, Agent, or Firm* — Borden Ladner Gervais LLP; Louis B. Allard

(57) ABSTRACT

Disclosed is an economical and effective way of producing a double sided wall using facing panels having a face surface and a back surface with a retaining structure. The facing panels are stacked in a back-to-back arrangement into a pair of first and second wall components connected by separate articulated connectors. The articulated connectors each have a first base connector that fits into a respective retaining groove in the first wall component and a second base connector that fits into a respective retaining groove of the second wall component. The first and second base connectors are connected to each other by a link that forms a first pivot joint at the first base connector and a second pivot joint at the second base connector.

25 Claims, 5 Drawing Sheets

Related U.S. Application Data continuation of application No. 14/876,871, filed on Oct. 7, 2015, now Pat. No. 9,464,431, which is a continuation of application No. 12/752,766, filed on Apr. 1, 2010, now Pat. No. 9,206,599, which is a continuation-in-part of application No. 12/525,491, filed as application No. PCT/CA2007/002351 on Dec. 21, 2007, now abandoned.

(60) Provisional application No. 60/887,877, filed on Feb. 2, 2007.

(51) Int. Cl.

| | |
|---|---|
| ***E04B 2/46*** | (2006.01) |
| ***E04B 2/86*** | (2006.01) |
| ***E04C 1/00*** | (2006.01) |
| *E02D 17/20* | (2006.01) |
| *E04B 2/02* | (2006.01) |

(52) U.S. Cl.

CPC ..... *E04C 1/00* (2013.01); *E02D 17/205* (2013.01); *E04B 2002/0247* (2013.01); *E04B 2002/0269* (2013.01); *E04B 2002/0282* (2013.01); *E04B 2002/867* (2013.01); *E04B 2103/02* (2013.01)

(58) Field of Classification Search

CPC ..... E04B 2002/0269; E04B 2002/0282; E04B 2002/867; E04B 2103/02; E04C 1/00; E02D 17/205

USPC ..... 52/426, 564

See application file for complete search history.

(56) References Cited

U.S. PATENT DOCUMENTS

| | | | | | |
|---|---|---|---|---|---|
| 791,291 | A | | 5/1905 | Roberts | |
| 1,033,988 | A | | 7/1912 | Coburn | |
| 1,052,788 | A | * | 2/1913 | Bates | E04B 1/161 52/127.3 |
| 1,214,964 | A | | 2/1917 | Small | |
| 1,226,214 | A | | 5/1917 | Hopkins | |
| 1,280,864 | A | * | 10/1918 | Sawyer | E04B 2/30 52/428 |
| 1,325,079 | A | * | 12/1919 | Coggan | E04B 2/30 52/564 |
| 1,329,893 | A | | 2/1920 | Flynn et al. | |
| 1,345,156 | A | | 6/1920 | Flynn | |
| 1,472,917 | A | | 11/1923 | Laird | |
| 1,567,085 | A | | 12/1925 | Rowland | |
| 1,624,369 | A | | 4/1927 | Serra | |
| 1,650,485 | A | * | 11/1927 | Blank | E04B 2/8647 52/274 |
| 1,726,903 | A | * | 9/1929 | Knight | E04B 2/30 52/428 |
| 1,818,416 | A | * | 8/1931 | Meara | E04B 2/30 52/564 |
| 1,907,053 | A | | 5/1933 | Flath | |
| 1,911,626 | A | * | 5/1933 | Larzelere | E04B 1/161 52/258 |
| 1,943,800 | A | | 1/1934 | Morrison | |
| 1,953,005 | A | | 3/1934 | Nagel | |
| 2,049,907 | A | | 8/1936 | Hess | |
| 2,061,822 | A | | 11/1936 | Bankert | |
| 2,121,943 | A | * | 6/1938 | Bem | E04B 2/10 52/562 |
| 2,126,394 | A | * | 8/1938 | Jansen | E04B 2/14 52/373 |
| 2,225,612 | A | | 12/1940 | Allen | |
| 2,261,510 | A | * | 11/1941 | Atcheson | E04B 1/4185 52/97 |
| 2,392,551 | A | | 1/1946 | Roe | |
| 2,544,488 | A | | 3/1951 | Chittenden | |
| 2,929,238 | A | | 3/1960 | Kaye | |
| 2,940,296 | A | * | 6/1960 | Gaspar | E04B 2/8635 52/426 |
| 3,129,531 | A | * | 4/1964 | Connor | E04H 9/00 52/81.4 |
| 3,238,684 | A | * | 3/1966 | Wood | E04B 2/8635 52/379 |
| 3,321,884 | A | * | 5/1967 | Hermann | E04B 2/8635 52/378 |
| 3,353,312 | A | | 11/1967 | Storch | |
| 3,353,315 | A | * | 11/1967 | Barker | E04C 2/22 428/167 |
| 3,391,507 | A | | 7/1968 | Downing | |
| 3,442,991 | A | * | 5/1969 | Lanz | B28B 1/503 264/42 |
| 3,481,093 | A | * | 12/1969 | Davidson | E04B 2/8635 52/293.1 |
| 3,546,833 | A | | 12/1970 | Perreton | |
| 3,607,643 | A | | 9/1971 | Paget | |
| 3,609,926 | A | | 10/1971 | Muse | |
| 3,616,153 | A | * | 10/1971 | Downs | E04C 1/40 428/138 |
| 3,676,967 | A | * | 7/1972 | Frati | E04B 2/8635 52/220.2 |
| 3,786,605 | A | | 1/1974 | Winfrey | |
| 3,854,256 | A | | 12/1974 | Wilce | |
| 3,877,236 | A | | 4/1975 | O'Neill et al. | |
| 3,950,908 | A | * | 4/1976 | Van Eyk | E01C 5/226 52/436 |
| 4,068,482 | A | | 1/1978 | Hilfiker | |
| 4,119,695 | A | * | 10/1978 | Asserback | B28B 7/32 249/153 |
| 4,164,598 | A | | 8/1979 | Wilhelm | |
| 4,229,922 | A | | 10/1980 | Clark, Jr. | |
| 4,285,181 | A | | 8/1981 | Van Loghem et al. | |
| 4,348,847 | A | | 9/1982 | Jukes | |
| 4,391,077 | A | | 7/1983 | Giess | |
| 4,400,925 | A | * | 8/1983 | Van Loghem | E04B 1/6158 52/282.3 |
| 4,438,605 | A | | 3/1984 | Delucia | |
| 4,439,967 | A | * | 4/1984 | Dielenberg | E04B 2/26 52/309.12 |
| 4,442,644 | A | | 4/1984 | Jukes | |
| 4,478,021 | A | | 10/1984 | Person | |
| 4,490,075 | A | | 12/1984 | Risi et al. | |
| 4,498,266 | A | | 2/1985 | Perreton | |
| 4,532,747 | A | | 8/1985 | Koetje | |
| 4,545,703 | A | | 10/1985 | Boynton | |
| 4,589,241 | A | | 5/1986 | Volpenhein | |
| 4,596,102 | A | | 6/1986 | Catani et al. | |
| 4,597,236 | A | | 7/1986 | Braxton | |
| 4,655,014 | A | | 4/1987 | Krecke | |
| 4,700,523 | A | | 10/1987 | Kohara | |
| 4,703,600 | A | * | 11/1987 | Suh | E04C 1/39 52/437 |
| 4,715,158 | A | * | 12/1987 | Manzelli | E04B 9/34 52/581 |
| 4,774,791 | A | | 10/1988 | Kafarowski | |
| 4,825,619 | A | | 5/1989 | Forsberg | |
| 4,833,856 | A | | 5/1989 | Zwagerman | |
| 4,835,928 | A | | 6/1989 | Scott | |
| 4,866,891 | A | | 9/1989 | Young | |
| 4,901,494 | A | * | 2/1990 | Miller | E04B 2/8647 249/216 |
| 4,914,887 | A | | 4/1990 | Meheen | |
| 4,949,515 | A | | 8/1990 | Krecke | |
| 4,956,949 | A | | 9/1990 | Francis | |
| 4,967,528 | A | | 11/1990 | Doran | |
| 5,033,912 | A | | 7/1991 | Vidal | |
| 5,107,652 | A | * | 4/1992 | Sosa | E02D 29/025 160/135 |
| 5,140,794 | A | | 8/1992 | Miller | |
| 5,154,542 | A | | 10/1992 | Klenert | |
| 5,160,215 | A | | 11/1992 | Jensen | |
| 5,161,918 | A | | 11/1992 | Hodel | |
| 5,214,898 | A | | 6/1993 | Beretta | |

(56) References Cited

U.S. PATENT DOCUMENTS 5,240,348 A * 8/1993 Breaux ..... B09B 1/008 405/129.8
5,315,802 A 5/1994 Hart
5,349,798 A * 9/1994 Gross ..... E04C 1/40 52/309.12
5,350,256 A 9/1994 Hammer
5,370,480 A 12/1994 Quaney
5,403,127 A 4/1995 Knudsen
5,435,111 A 7/1995 Cox et al.
5,468,098 A 11/1995 Babcock
5,472,297 A 12/1995 Heselden
5,474,405 A 12/1995 Anderson et al.
5,489,074 A 2/1996 Arnold et al.
5,501,049 A 3/1996 Francis et al.
5,505,563 A 4/1996 Curt
5,513,475 A 5/1996 Schaaf et al.
5,570,552 A 11/1996 Nehring
5,586,841 A 12/1996 Anderson et al.
5,647,166 A 7/1997 Neff
5,647,695 A 7/1997 Hilfiker et al.
5,673,530 A 10/1997 Bailey, II
5,688,078 A 11/1997 Hammer
5,707,184 A 1/1998 Anderson et al.
5,709,060 A * 1/1998 Vaughan ..... E04B 2/54 52/426
5,735,643 A 4/1998 Castonguay et al.
5,788,423 A 8/1998 Perkins
5,845,448 A 12/1998 Potvin
5,851,088 A 12/1998 Anderson et al.
5,930,947 A 8/1999 Eckhoff
5,934,039 A 8/1999 Guy
5,957,744 A 9/1999 Mott et al.
5,983,585 A 11/1999 Spakousky
6,006,803 A * 12/1999 Nakanishi ..... B27F 5/02 144/345
6,024,517 A 2/2000 Castonguay et al.
6,062,772 A 5/2000 Perkins
6,148,576 A 11/2000 Janopaul, Jr.
6,176,059 B1 1/2001 Cantarano et al.
6,178,711 B1 * 1/2001 Laird ..... E04B 2/8635 52/357
6,189,282 B1 * 2/2001 VanderWerf ..... E04B 2/14 52/582.1
6,238,144 B1 * 5/2001 Babcock ..... E02D 29/0283 405/262
6,240,692 B1 6/2001 Yost et al.
6,240,700 B1 * 6/2001 Sheu ..... E02D 5/20 405/267
6,394,703 B1 * 5/2002 Renouf ..... E04B 1/4185 52/97
6,490,825 B1 12/2002 Dillon et al.
6,622,445 B1 9/2003 Shillingburg et al.
6,637,167 B2 10/2003 Hanna
6,662,520 B1 12/2003 Nelson
6,701,687 B1 3/2004 Shillingburg
6,874,291 B1 4/2005 Weber
6,880,297 B2 4/2005 Johnston
6,912,823 B2 7/2005 MacDonald et al.
6,935,081 B2 8/2005 Dunn et al.
6,953,309 B1 10/2005 Tufts et al.
6,978,581 B1 12/2005 Spakousky
7,073,306 B1 * 7/2006 Hagaman ..... E04B 1/35 249/20
7,198,435 B2 4/2007 Dolan et al.
7,243,897 B2 * 7/2007 Huber ..... E02D 27/01 249/216
7,320,201 B2 * 1/2008 Kitchen ..... E04B 2/8623 52/309.11
7,410,328 B2 8/2008 Hamel
7,464,509 B1 12/2008 Brown
7,503,729 B2 3/2009 Hammer et al.
7,591,447 B2 9/2009 Hammer et al.
7,827,752 B2 11/2010 Scherrer
7,934,345 B2 * 5/2011 Marsh ..... B27F 5/02 144/345
8,206,065 B2 6/2012 Heselden
8,540,915 B2 * 9/2013 Scherer ..... B28B 3/08 264/219
8,596,926 B2 12/2013 Heselden
8,689,501 B2 4/2014 Chamoux
8,777,514 B2 7/2014 Heselden
8,851,803 B2 10/2014 Bott
8,992,131 B2 3/2015 Castonguay et al.
9,151,051 B2 10/2015 Cossette et al.
9,234,347 B2 1/2016 Cossette et al.
9,714,510 B2 7/2017 Castonguay et al.
10,145,102 B2 12/2018 Castonguay et al.
2001/0029717 A1 10/2001 Spakousky
2002/0124508 A1 9/2002 Dunn et al.
2003/0126821 A1 7/2003 Scherer et al.
2003/0140585 A1 7/2003 Dueck et al.
2003/0182011 A1 9/2003 Scherer
2005/0120670 A1 6/2005 Ness et al.
2006/0110223 A1 5/2006 Dawson et al.
2006/0179779 A1 8/2006 Ness
2007/0266656 A1 11/2007 Blocken
2008/0005991 A1 * 1/2008 Meilleur ..... E04B 2/8635 52/426
2008/0057801 A1 3/2008 Duffy
2008/0086968 A1 * 4/2008 Kitchen ..... E04B 2/8623 52/426
2008/0236084 A1 10/2008 Pontarolo
2009/0013629 A1 1/2009 Boeshart
2009/0041552 A1 2/2009 Hammer
2009/0308011 A1 12/2009 Philippe
2011/0217127 A1 9/2011 MacDonald
2012/0060438 A1 3/2012 Jensen
2012/0117904 A1 5/2012 Bouchard et al.
2013/0081353 A1 4/2013 Jensen
2016/0024786 A1 1/2016 Castonguay et al.
2016/0186433 A1 6/2016 Cossette et al.

FOREIGN PATENT DOCUMENTS

CA 2447646 A1 11/2002
CA 2485870 A1 11/2003
CA 2544152 A1 10/2006
CA 2550359 A1 12/2007
CN 2353796 Y 12/1999
DE 2549162 A1 5/1977
DE 4134439 A1 4/1993
DE 4232029 A1 12/1994
DE 10110798 A1 2/2002
DE 202008012263 U1 11/2008
FR 2583808 A1 12/1986
FR 2740488 A1 4/1997
JP S58156637 A 9/1983
KR 20110011074 A 2/2011
NL 1024629 C1 11/2004

OTHER PUBLICATIONS

Canadian Patent Application No. 2,676,369, Office Action dated Nov. 28, 2013.
European Application No. 07855631, Supplementary European Search Report dated Oct. 2, 2015.
International Patent Application No. PCT/CA2007/002351, International Preliminary Report on Patentability dated Aug. 4, 2009.
International Patent Application No. PCT/CA2007/002351, International Search Report dated Apr. 1, 2008.
U.S. Appl. No. 12/525,491, Office Action dated Apr. 21, 2014.
U.S. Appl. No. 12/525,491, Office Action dated Aug. 29, 2013.
U.S. Appl. No. 12/525,491, Office Action dated Dec. 22, 2011.
U.S. Appl. No. 12/525,491 Office Action dated Jul. 19, 2011.
U.S. Appl. No. 12/525,491, Office Action dated Jul. 5, 2013.
U.S. Appl. No. 12/525,491, Office Action dated Mar. 6, 2013.
U.S. Appl. No. 12/752,766, Notice of Allowance dated Jul. 31, 2015.
U.S. Appl. No. 12/752,766, Office Action dated Apr. 25, 2012.

(56) References Cited

OTHER PUBLICATIONS

U.S. Appl. No. 12/752,766, Office Action dated Jan. 18, 2013.
U.S. Appl. No. 12/752,766, Office Action dated Jul. 18, 2013.
U.S. Appl. No. 12/752,766, Office Action dated Nov. 6, 2014.
U.S. Appl. No. 14/876,871, Notice of Allowance dated Jun. 10, 2016.
U.S. Appl. No. 14/876,871, Office Action dated Nov. 19, 2015.
U.S. Appl. No. 15/267,719, Notice of Allowance dated Jun. 23, 2017.
U.S. Appl. No. 15/267,719, Office action dated Feb. 8, 2017.
Written Opinion for Application No. PCT/CA2007/002351, dated Apr. 1, 2008, 6 pages.
U.S. Appl. No. 16/165,638, Non-Final Office Action dated Feb. 1, 2019.
European Application No. 11827877.9, Office Action dated Jun. 28, 2018.
Mexican Patent Application No. MX/a/2016/012958, Office Action dated Jun. 14, 2018—English Translation Not Available.
Mexican Patent Application No. MX/a/2015/010891, Office Action dated Sep. 19, 2018—English Translation not Available.
U.S. Appl. No. 15/625,254, Notice of Allowance dated Jun. 26, 2016.
U.S. Appl. No. 15/821,399, Non-Final Office Action dated Sep. 13, 2018.
European Patent Application No. 07855631.3, Communication pursuant to Article 94(3) EPC dated Apr. 24, 2019.
Canadian Patent Application No. CA2901433, Office Action dated Aug. 15, 2019.
European Patent Application No. EP11827877.9, Communication pursuant to Article 94(3) EPC dated Jul. 5, 2019.
Mexican Patent Application No. MX/a/2014/008955, Office Action dated Jun. 4, 2019.
U.S. Appl. No. 16/165,638, Final Office Action dated Jul. 18, 2019.

* cited by examiner

WALL WITH DECORATIVE FACING

RELATED APPLICATIONS

This application is a Continuation application from U.S. patent application Ser. No. 15/267,719, filed Sep. 16, 2016, which is a Continuation application from U.S. patent application Ser. No. 14/876,871, filed Oct. 7, 2015, issued Oct. 11, 2016 as U.S. Pat. No. 9,464,431, which is a Continuation application from U.S. patent application Ser. No. 12/752,766, filed Apr. 1, 2010, issued Dec. 8, 2015 as U.S. Pat. No. 9,206,599, which is a Continuation-in-Part application from U.S. patent application Ser. No. 12/525,491, filed Jul. 31, 2009, which is a 371 of PCT/CA2007/002351, filed Dec. 21, 2007, which claims priority from U.S. Ser. No. 60/887,877, filed on Feb. 2, 2007, all of which are incorporated herein by reference.

FIELD OF THE INVENTION

The present invention is generally directed toward decorative walls such as retaining walls and freestanding walls having a decorative surface. In particular, the invention is directed to modular walls with a decorative facing and components of such walls. More specifically, the present invention is directed toward walls, which have a pair of decorative surfaces.

BACKGROUND OF THE INVENTION

Retaining walls are used in landscaping around residential or commercial buildings. Retaining walls can be made of various materials, but for reasons of durability are most often either concrete structures cast in situ or walls formed of stacked courses of natural stone or masonry blocks. Concrete masonry blocks have become the most popular retaining wall components, due to their ease of manufacture, transport and handling.

Freestanding walls are often used as demarcation structures along roads, walkways or property lines. These walls can be cast in situ or modular, preferably made of stacked blocks, for added flexibility in shaping the wall.

Conventional concrete masonry blocks are generally molded in a dry cast process in which a concrete mixture is filled into a mold box and compressed to generate a pre-consolidated block. This pre-block is removed from the mold box and transported to a setting location at which the block is stored for setting of the concrete mixture. Due to the particularities of the molding process used, the pre-block can be provided with an embossed surface structure, but only on the top and bottom surfaces. Thus, this process does not allow for the molding of a dry cast concrete block with a front decorative surface. Several methods have been developed to provide hollow dry cast blocks with a textured front surface. Molding a slab including several blocks and subsequently braking the slab into individual blocks allows for the creation of an irregular, rough front surface similar to the surface of a split natural stone. Alternatively, the smooth front surface of a finished molded block can be subjected to a percussive treatment which brakes up and roughens the front surface. However, neither method allows for the manufacture of a hollow block with any decorative front surface, for example a surface having a regular surface structure, such as an embossed surface.

Thus, an economical and effective method is desired for providing a decorative finish on any building, retaining or freestanding wall, preferably on both sides of a freestanding wall.

Therefore, improvements in producing freestanding walls are desirable.

SUMMARY OF THE INVENTION

In a first aspect, the present disclosure presents a method of providing a double sided hollow wall. The method comprises providing a plurality of concrete facing panels each having a front surface and an opposite, back surface, the back surface including at least one retaining structure. The method further comprises stacking the concrete facing panels back-to-back in spaced apart parallel rows to form a pair of spaced apart parallel first and second wall components and an intermediate space. The method also comprises, in each row, connecting a first concrete facing panel in the first wall component with a second concrete facing panel in the second wall component in the back-to-back orientation, using at least one separate connector having a first connecting end for engagement in the at least one retaining structure of the first concrete facing panel and a second connecting end for engagement to the at least one retaining structure in the second concrete facing panel to form the double sided wall. In this method, the at least one separate connector is an articulated connector that has a link for forming a pivot joint between the first connecting end and the second connecting end.

In a second aspect of the present disclosure, there is provided a wall kit for a double sided hollow wall. The wall kit comprises a plurality of concrete facing panels each having a front surface and an opposite back surface, the back surface including at least one retaining structure; and a plurality of connectors for connecting the plurality of concrete facing panels in back-to-back, spaced apart parallel rows to form a pair of spaced apart parallel first and second wall components with an intermediate space. The connectors are articulated connectors each having a first connecting end, a second connecting end and a link, the link forms a pivot joint between the first connecting end and the second connecting end, the first connecting end removably engages a respective retaining structure of a concrete facing panel of the first wall, and the second connecting end removably engages a respective retaining structure of a concrete facing panel of the second wall.

In a third aspect of the present disclosure, there is provided a double sided hollow wall. The wall comprises: a plurality of concrete facing panels, each concrete facing panel having a front surface and an opposite back surface with a retaining groove; the facing panels being stacked side-by-side and in a spaced apart back to back arrangement for forming back-to-back and spaced apart parallel first and second wall components with an intermediate space. The wall further comprises a plurality of first connectors respectively connecting the retaining groove in a concrete facing panel in the first wall component to the retaining groove in at least one concrete facing panel in the second wall component to form the double sided hollow wall. The connectors are articulated connectors each having a first connecting end, a second connecting end and a link, the link forms a pivot joint between the first connecting end and the second connecting end. The first connecting end removably engages a respective retaining structure of a concrete facing panel of the first wall, and the second connecting end removably engages a respective retaining structure of a concrete facing panel of the second wall.

BRIEF DESCRIPTION OF THE DRAWINGS

Preferred embodiments of the invention will now be further described by way of example only and with reference to the attached drawings, wherein.

DETAILED DESCRIPTION

Before explaining the present invention in detail, it is to be understood that the invention is not limited to the preferred embodiments contained herein. The invention is capable of other embodiments and of being practiced or carried out in a variety of ways. It is to be understood that the phraseology and terminology employed herein are for the purpose of description and not of limitation.

Figure 1:
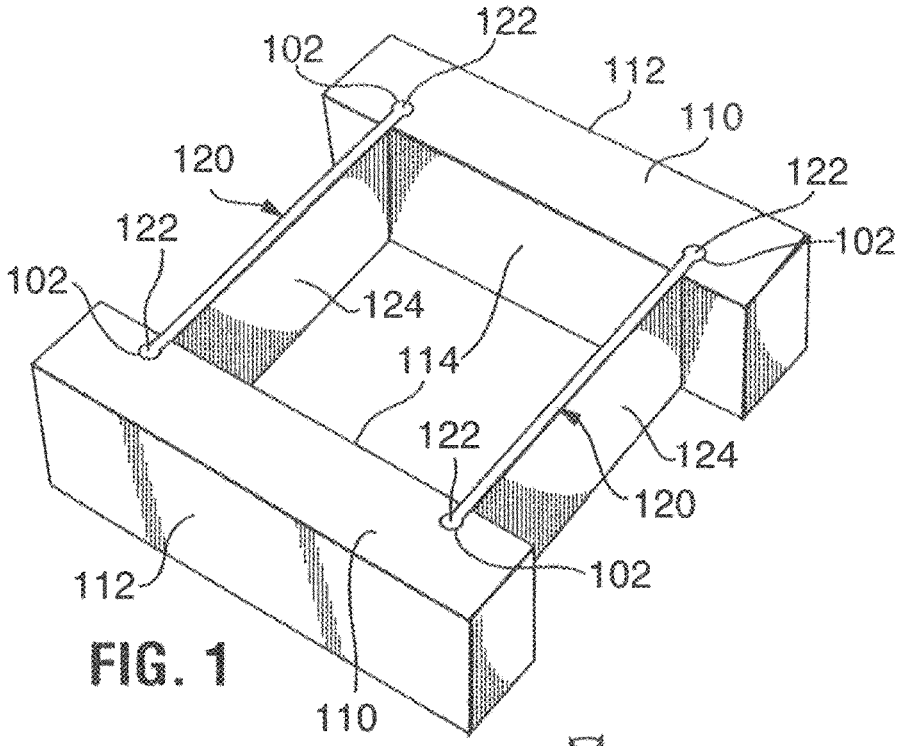
FIG. 1 illustrates a pair of facing panels connected back-to-back to form a hollow wall with double sided decorative finish.

FIG. 1 illustrates the method in accordance with the invention of providing a decorative wall 100, such as a retaining wall or freestanding wall, by connecting pairs of facing panels 110 having a decorative surface 112 in a back-to-back arrangement. In the illustrated embodiment, each facing panel 110 is connected by way of connectors 120, with at least one other facing panel. The connectors respectively engage at least two facing panels. The preferred connectors 120, which are discussed in more detail with reference to FIGS. 3*a*-3*c*, 7 and 8 have at least a pair of spaced apart parallel, cylindrical stems 122 connected by an intermediate web 124. The stems 122 form interlocking members, which engage and are reliably held in keyhole slots 102 respectively provided in the rear face 114 of the facing panels 110. The connectors 120 are preferably inserted first into the keyhole slots 102 in one facing panel. This allows the installer to mount the second facing panel 110 by sliding it onto the already installed connector. The wall is preferably made of stacked facing panels 110 as illustrated. The weight of the facing panels 110 can be supported on a footing of the wall (not shown), or on a separate footing for each partial wall formed by the facing panels 110 of one side of the double sided decorative wall. For ease of use, the connectors 120 are preferably symmetrical, which means the cylindrical stems 122 are identical in cross-section and size, but non-symmetrical variants with stems 122 of different diameter and cross-sectional shape can also be used.

Figure 2A:
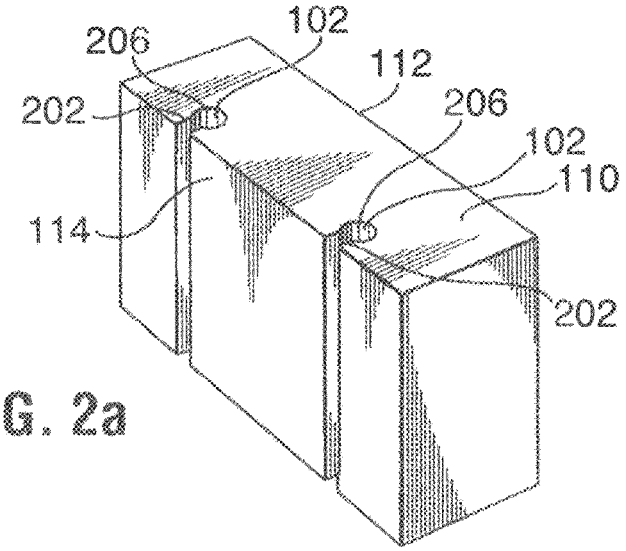
FIG. 2*a* is a perspective view of a facing panel for use in a wall in accordance with the invention.

FIG. 2*a* illustrates a facing panel 110 for use in a wall in accordance with the invention. The facing panel 110 is a dry cast concrete block which was compressed in the top to bottom direction during manufacture and has a top surface 112 and a bottom surface 114. The facing panel 110 preferably has an embossed decorative surface 112, more preferably an embossed, patterned surface. The facing panel 110 has at least one keyhole slot 102, preferably a pair of spaced apart parallel keyhole slots 102, in its bottom surface 114 (bottom surface during molding of the panel). Each keyhole slot 102 has a slot portion 202 penetrating the back surface 114 of the facing panel 110 and a cylindrical bore portion 206 connected thereto. The stems 122 of the connectors 120 are respectively inserted into the keyhole slots 206 to mount the facing panels 110 in a back-to-back arrangement (see FIG. 1). The facing panel 110 is preferably sized and shaped to permit stacking into a continuous wall 100.

Figure 2B:
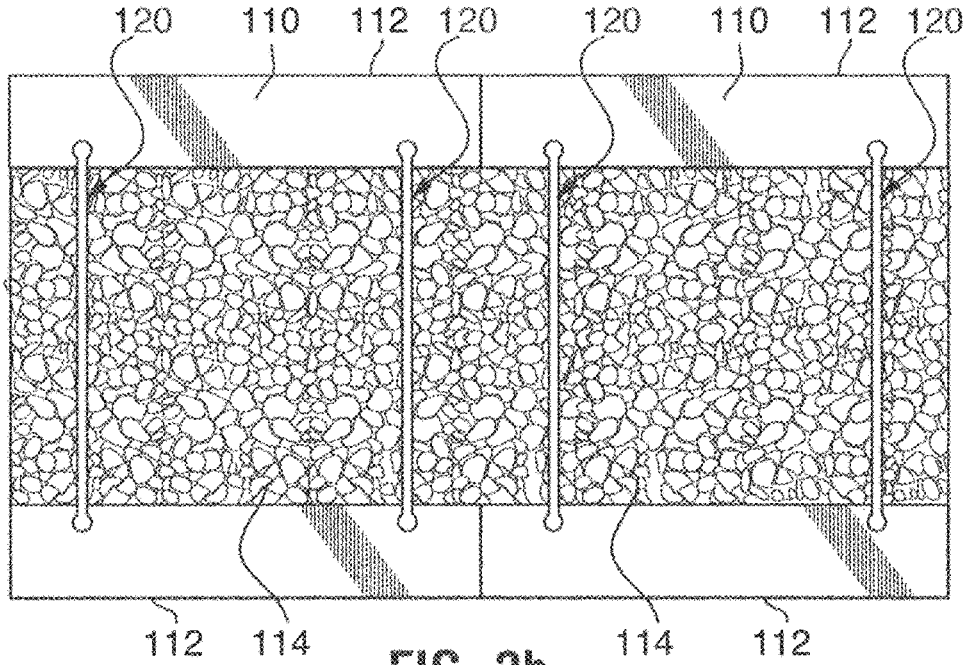
FIG. 2*b* is a schematic top view of the decorative wall of FIG. 1 with facing panels connected in a back-to-back arrangement, and filled with gravel.

FIG. 2*b* illustrates the method in accordance with the invention for providing a wall 100 with a double-sided decorative finish 112. FIG. 2*b* is a schematic top view of a decorative wall 100 in accordance with the invention including two pairs of decorative facing panels 110 arranged side-by-side with each pair connected by connectors 120 to the other pair in a back-to-back orientation. Each facing panel 110, preferably a facing panel intended for providing a decorative finish on a wall or wall block, is provided with an embossed decorative facing surface. The decorative wall 100 is preferably made of a multitude of facing panels 110 stacked in rows to form a pair of spaced apart walls connected in space apart back-to-back orientation by the intermediate connections 120. The facing panels 110 are arranged in the back-to-back orientation so that all outside surfaces of the resulting wall 100 have a decorative finish. Facing panels 110 are dry cast concrete blocks which were compressed in the top to bottom direction during manufacture, but are mounted with their bottom surfaces 112 facing one another in the decorative wall 100 so that the top surface 114 of the facing panel 110 is facing outward in the wall and thereby forms the new facing surface(s) of the wall 100.

Multiple facing panels 110 as shown in FIGS. 1, 2*a*, 4, 5*a* to 5*c* and 6 can be used to build a decorative wall 100. The decorative facing panels 110 are thereby stacked in rows, preferably staggered for additional stability, to form a decorative wall. For maximum installation flexibility and ease of handling, the decorative panels are preferably handled in the disassembled condition, which means some facing panels 110 are first separately stacked to form a partial first wall and then the facing panels are subsequently connected back-to-back to the already stacked panels to form a partial second wall spaced apart from the first partial wall and connected thereto by the connectors 120. For that purpose, the invention provides a kit for a decorative wall, which kit includes a number of facing panels and connectors for connecting the facing panels back-to-back. The interconnection of the back-to-back facing panels is preferably carried out on a row by row basis, as each row of facing panels is finished, so that the connectors need not be forced through the keyhole slots of more than one panel. In the alternative, only the insertion of the connectors into one partial wall is done on a row by row basis. However, this will require moving facing panels for the other partial wall along several connectors, which may increase the time required for installation of the complete wall. Jumper panels can be included in the wall, which are larger in size than the remaining panels and possibly rotated by 90°. When jumper panels of the same principle construction as the surrounding panels are used, which are rotated by 90°, the facing panel back-to-back thereto is preferably installed immediately after placement of the jumper panel and before the rows of panels around the jumper panel are finished. Sliding of the facing panel onto the connector in the jumper panel may no longer be possible once the connectors of the adjoining panels are installed, due to their orientation perpendicular thereto. However, where jumper panels are used which have keyhole slots oriented 90° to those of regular panels, installation of the facing panel back-to-back onto the jumper panel can be carried out in the ordinary course of installation since the slots in the jumper panel are then parallel to those in the surrounding panels. For added stability of the decorative wall, the connectors can be inserted into the keyhole slots so that they engage the facing panels in vertically adjacent rows of facing panels and thereby not only connect the first and second walls, but also stacked rows.

Figure 4:
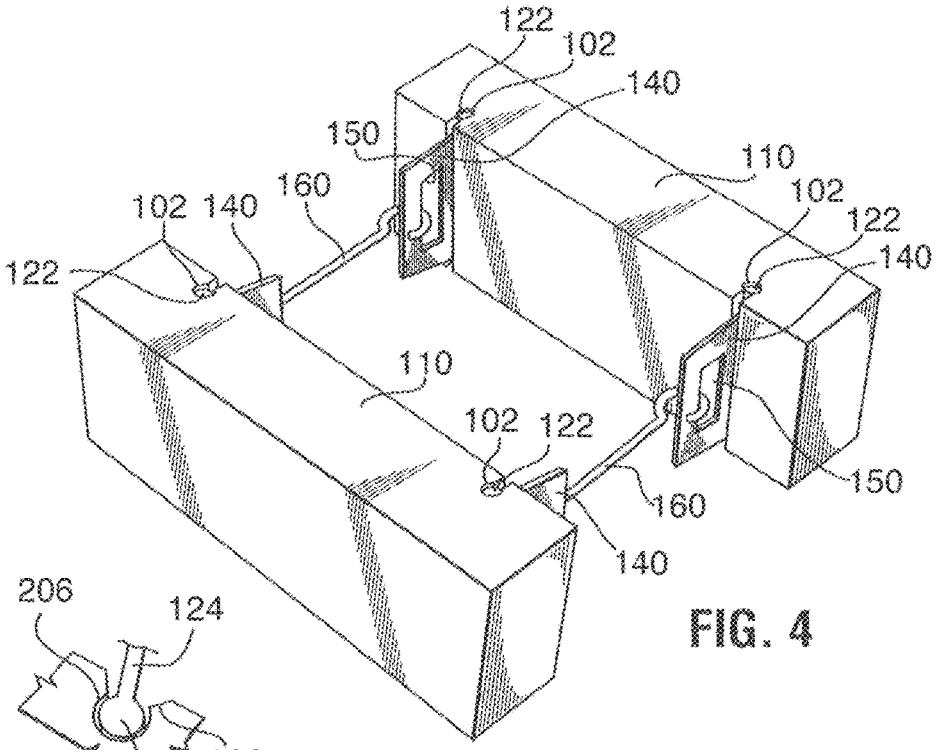
FIG. 4 is a top perspective view of decorative wall components in accordance with the invention including a pair of decorative panels connected back-to-back with a modular connector system.

FIG. 4 shows an alternate method of connecting the facing panels of the respective partial walls by using base connectors 140 which each engage only one facing panel 110, but include an opening or eyelet 150 for engagement by a hook-shaped link 160, which may be of adjustable length (not illustrated) and is shaped and constructed to engage a base connector 140 at each end. Alternatively, the link 160 may incorporate one base connector 140 at one end.

Figure 5B:
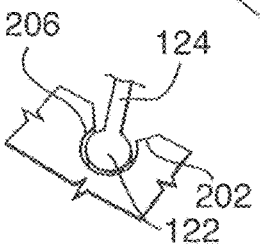
FIGS. 5*a* to 5*c* are perspective top views of decorative wall components in accordance with the invention including a pair of decorative facing panels connected back-to-back with an X-shaped connector.
Figure 5C:
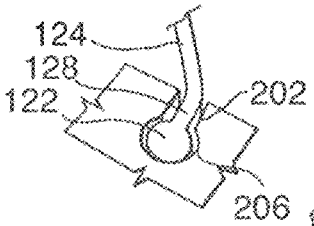
Figure 5A:
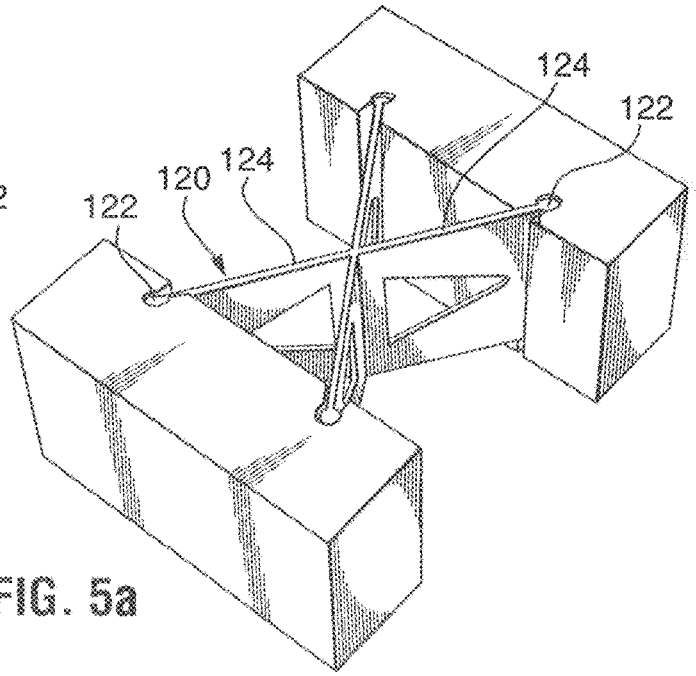

As illustrated in FIGS. 5*a* to 5*c*, the keyhole slots 102 in the back surface of the facing panels 110 may be shaped to interface with a Y or X-shaped connector 120 (see FIGS. 5*a* to 5*c* and 6) having webs 124 which are oriented at an acute angle to the rear surface 114 of the facing panel 110 when the connector and facing panel are interengaged. To accommodate the orientation of the webs 124, the slot portion 202 of the keyhole slots 102 in the rear surface 114 of the facing panels are tapered inwardly, thereby forming an outwardly widening V-groove in the rear surface 114 (see FIG. 5*b*). Alternatively, the webs 124 of the X and Y-shaped connectors 120 may be crimped adjacent their stems 122 with the crimped portion 128 oriented to engage a slot portion 202 with parallel side walls (see FIG. 5*c*).

The keyhole slots 102 in the facing panels 110 will now be discussed in more detail with reference to FIG. 2*a*. Each keyhole slot 102 has a slot portion 202 penetrating the rear surface 114 of the facing panel 110 and a cylindrical bore portion 206 connected thereto. The cylindrical bore portion 206 is sized and shaped for receiving one of the interconnecting members of the connectors, the stems 122 (see FIGS. 3*a*-3*c*). The slot portion 202 is sized and shaped for receiving the web 124 of the connector 120 (see FIGS. 3*a*-3*c*), the width of the slot portion 202 being less than the diameter of the stem 122 in order to prevent the connector 120 being pulled out of the keyhole slot 102. For maximum flexibility in connecting the facing panels 110 to one another, the facing panels preferably have a pair of retaining slots 102 in the rear surface 114. When multiple keyhole slots 102 are provided, the slots are preferably parallel and equidistantly spaced on the rear surface 114 of the facing panels 110. The slots are preferably oriented vertically or horizontally and centered on the panels when in the installed condition. Although other orientations of the slots are possible those orientations may make assembly of the decorative wall more challenging. The keyhole slots 102 preferably extend completely across the rear surface 114 to the facing panel 110. However, closed end keyhole slots 102 can also be used (not illustrated).

Figure 3C:
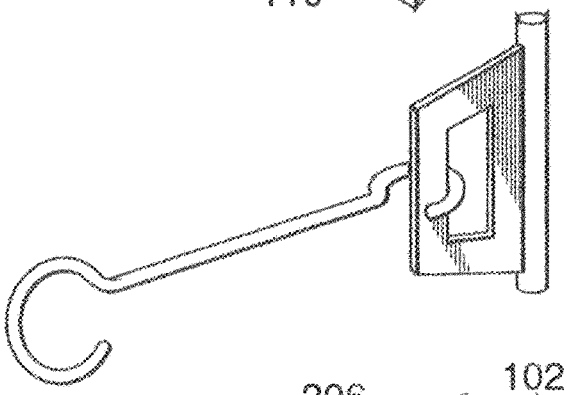
FIGS. 3*a* to 3*c* show different exemplary spacers in accordance with the invention.
Figure 3A:
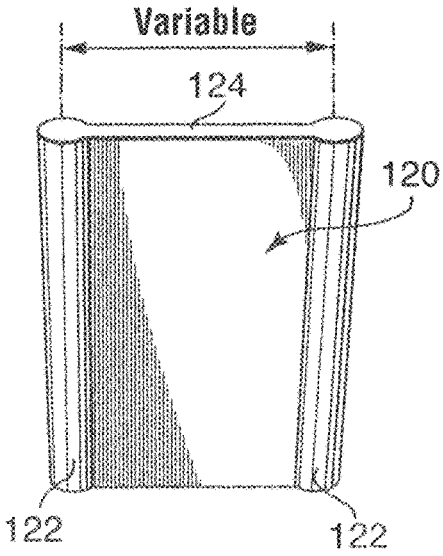
Figure 3B:
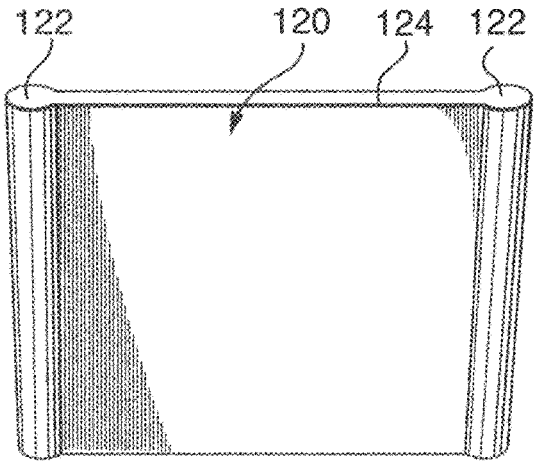

FIGS. 3*a*-3*c* show connectors of different construction. FIG. 3*a* illustrates the principle connector 120 in accordance with the invention, which is preferably of symmetrical construction to facilitate its use in the decorative wall of the invention in different orientations. The connector 120 includes a planar web 124 with opposite ends 125, 126 and a stem portion 122 at each of the ends. The stem portion 122 is preferably cylindrical, for interfacing with the keyhole slots 102 in the facing panels, but can be of any shape with allows engagement with the retaining recess in a facing panel and prevents the connector being pulled out of the retaining recess. FIG. 3*b* shows a variant of the connector shown in FIG. 3*a*, wherein the web 124 is longer than the height of the connector. This long connector is particularly suited for fillable decorative walls. The short connector of FIG. 3*a* is suited for thin decorative walls with little spacing between the back-to-back panels.

FIG. 3*c* shows a base connector 140 shown in FIGS. 3*a* and 3*b* which is a variant of connector 160, wherein only one end of the web 112 is provided with a stem 122 and the web 112 is further provided with an opening or eyelet 150 for engagement by a link 160, preferably of adjustable length (not shown). This allows the back-to-back connection of facing panels wherein the keyhole slots are staggered in the opposing blocks and, thus, not sufficiently aligned to permit the use of connectors 120 of planar construction. This base connector 140 in combination with link 160 is especially advantageous for the building of curved decorative walls, wherein, due to the spacing between the partial walls of facing panels, the keyhole slots 102 in the panels of one partial wall are misaligned with those in the other partial wall.

The connectors 120 can be made of any material sufficiently strong to reliably connect the facing panels 110 of the partial walls. The connectors are preferably made of any material which will be resistant to deterioration upon exposure to the elements, soil, gravel and the like. The most preferred material is plastic, although non-corroding metal alloys or metal connectors with a non-corroding surface finish can also be used.

Although all the preferred connectors 120, 140 described herein include interlocking members in the form of the cylindrical stems 122 intended for being mounted to the facing panels 110 by sliding them along the keyhole slots 102, connectors with stems of different cross-section can also be used, the only requirement being that the stems have a shape and thickness which prevents the connection being pulled out of the keyhole slot in which it is engaged. Furthermore, connector and retaining groove combinations other than those particularly exemplified can be used without deviating from the present invention. For example connectors of the snap in type can be used (not shown).

Of course, it will be readily apparent to the art skilled person that a retaining structure other than keyhole slots can be provided in the panels 110 as long as a reliable interlocking engagement between the retaining structure and the connectors respectively used is ensured. For example, the retaining structure can be in the form of a slot or bore and the connector can be a compressible/expandable connector which is insertable into the slot or bore and locks in the slot or bore when fully inserted in order to reliably retain the connector in the slot.

Figure 6:
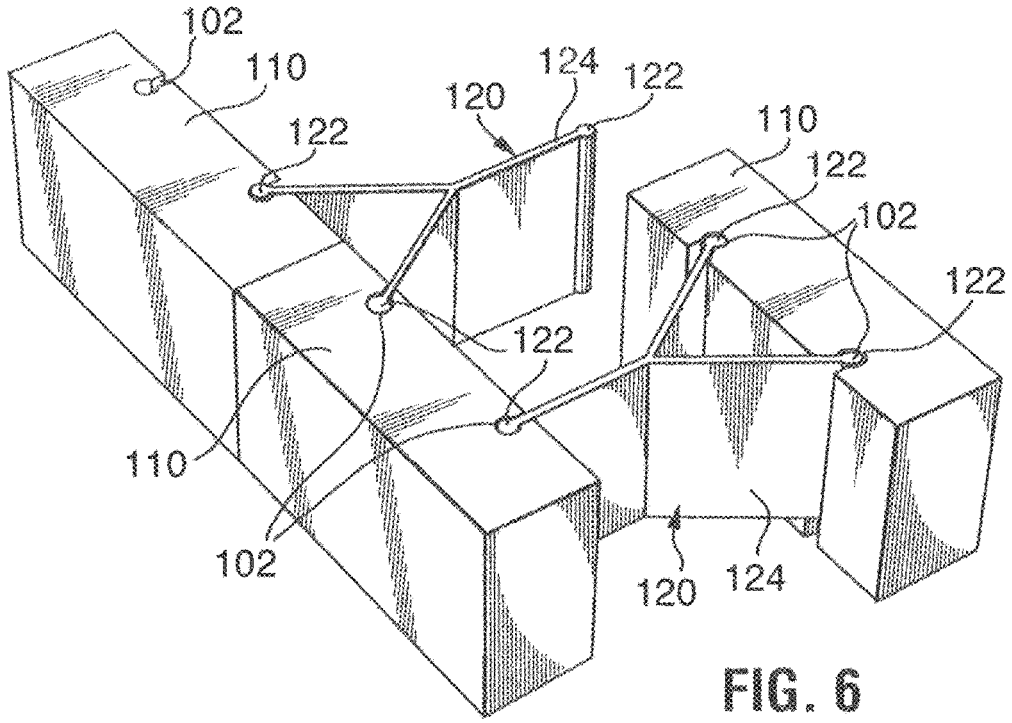
FIG. 6 is a perspective top view of a position of an exemplary wall in accordance with the invention having decorative facing panels on both sides and Y-shaped connectors.

FIG. 6 illustrates a wall in accordance with the invention including facing panels 110 and connectors 120. However, the connectors have three webs 124 which are arranged in a Y orientation and each include a stem 122 for interfacing with a keyhole slot 102 in a facing panel 110. Y-shaped connectors provide two advantages, they provide the wall with lateral stability against shifting and they allow the connection of side-by-side facing panels 110 by inserting the stem 122 on each of the forked of the connector into a keyhole slot of a different one of a pair of side by side panels. This provides added strength to the wall and reduces buckling of the partial walls of facing panels.

Figure 7:
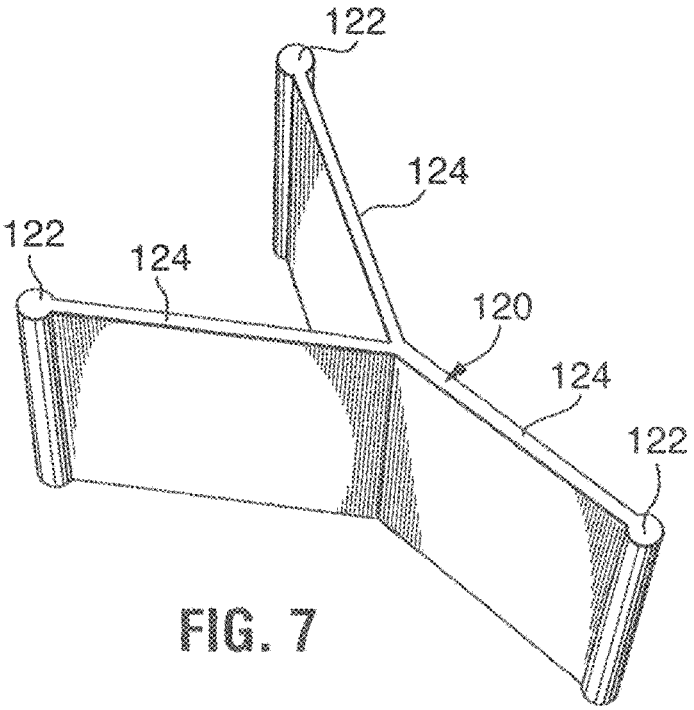
FIG. 7 illustrates a Y-shaped connector in accordance with the invention.

FIG. 7 illustrates a Y-shaped connector as shown in use in FIG. 6, wherein all three webs are of the same length and each include a cut-out or opening 129, the structural purpose of which will be discussed in more detail in relation to FIG. 9 below. Of course, providing the opening 129 also reduces the amount of material used for the connector, thereby reducing its unit cost. The webs 124 may also be of different length, with the webs in the forked end either being of equal length, for straight walls, or of different length, for curved walls (not illustrated).

Figure 8:
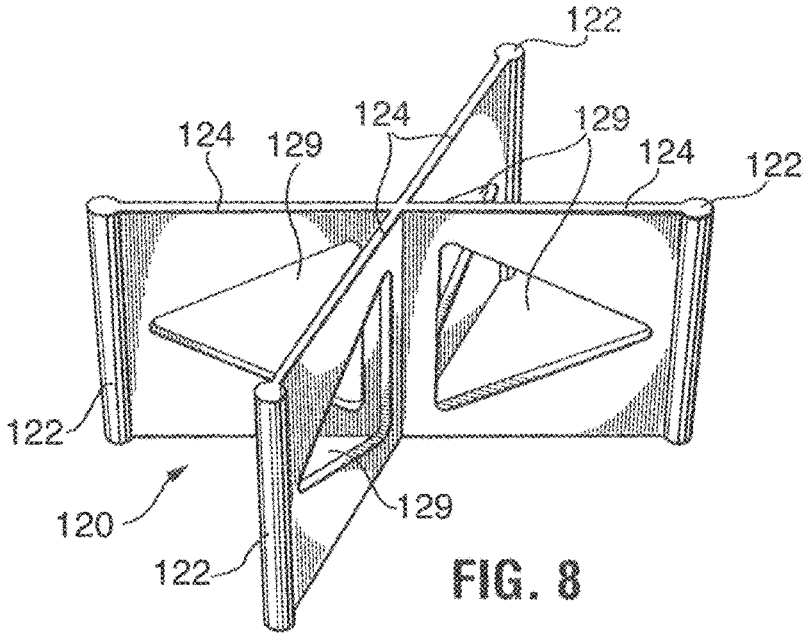
FIG. 8 illustrates an X-shaped connector in accordance with the invention.

FIG. 8 illustrates an X-shaped connector 120 in accordance with the invention. The connector includes a pair of intersecting webs 124 which each include a stem 122 at their respective ends for interconnection with a retaining recess or keyhole slot 102 in a facing panel 110. The pair of stems 122 respectively located on opposite sides of the intersection can be engaged in the same facing panel 110 or respectively in one keyhole slot of laterally adjacent panels. As with the Y-shaped connector, each web 124 is preferably provided with a cut-out or opening 129.

Figure 9:
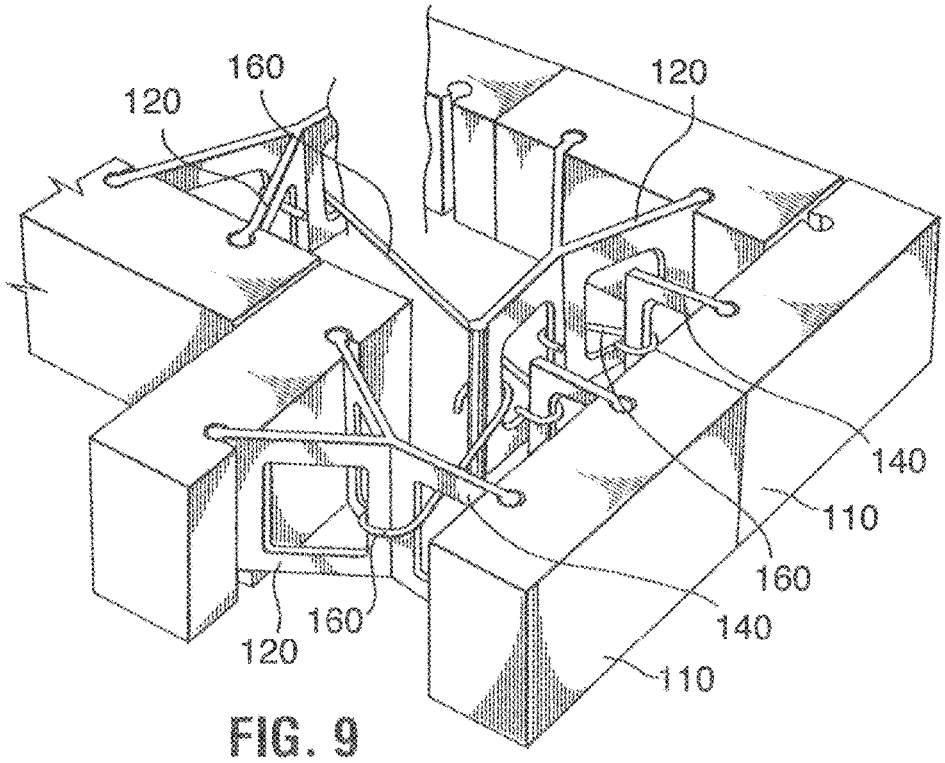
FIG. 9 schematically illustrates a corner construction using facing panels and connectors, in accordance with the invention.

FIG. 9 schematically illustrates an exemplary corner arrangement of a double sided decorative wall in accordance with the invention. As is apparent, the facing panels 110 are stacked to form a corner in each of the parallel partial walls. Y-shaped connectors 120 are used as well as base connectors 140 and links 160 to provide multi-directional stability to the corner arrangement, in an effort to prevent buckling of the respective partial walls of facing panels. Maximum stability is achieve by placing the connectors 120, 140 into the keyhole slots of vertically adjacent rows of facing panels (not illustrated) in order to connect subsequent layers in each wall with one another.

The facing panels 110 are preferably provided with a bevel at their lateral ends in order to allow for a closer fit of the facing panels in curved wall applications. The curvature of the wall can then be adjusted by using facing panels of different length, longer panels being used in the outer partial wall of the decorative wall. Generally, the shorter the blocks, the tighter the radius that can be created.

While the invention has been described with a certain degree of particularity, it is understood that the invention is not limited to the embodiments set forth herein for purposes of exemplification, but is to be limited only by the scope of the attached claims, including the full range of equivalency to which each element thereof is entitled.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A method for providing a double sided hollow wall, the method comprising:

providing a plurality of monolithic concrete facing panels each having a front surface, an opposite back surface, a top surface and a bottom surface, the back surface defining at least one retaining structure, each of the at least one retaining structure extending from the top surface to the bottom surface;

stacking the concrete facing panels back-to-back in spaced apart parallel rows to form a pair of spaced apart parallel first and second wall components and an intermediate space;

in each row, connecting a first concrete facing panel in the first wall component with a second concrete facing panel in the second wall component in the back-to-back orientation, using at least one separate connector having a first connecting end for engagement with one of the at least one retaining structure defined by the back surface of the first concrete facing panel and a second connecting end for engagement with one of the at least one retaining structure defined by the back surface of the second concrete facing panel to form the double sided wall, the first connecting end connecting to one of the at least one retaining structure of the first concrete facing panel being effected by sliding, starting at one of the top surface and the bottom surface of the first concrete facing panel, the first connecting end into the one of the at least one retaining structure of the first concrete facing panel, the second connecting end connecting to one of the at least one retaining structure of the second concrete facing panel being effected by sliding, starting at one of the top surface and the bottom surface of the second concrete facing panel, the second connecting end into the one of the at least one retaining structure of the second concrete facing panel;

the at least one separate connector being an articulated connector having a link for forming a pivot joint between the first connecting end and the second connecting end.

2. The method of claim 1, wherein:

the first connecting end has a first base connector, the second connecting end has a second base connector, the link has a first link end and a second link end, the first link end is pivotally connected to the first base connector, and the second link end is pivotally connected to the second base connector, the step of connecting comprising engaging the first base connector to a respective retaining structure of the first concrete facing panel and engaging the second base connector to a respective retaining structure of the second concrete facing panel, wherein:

the first base connector is configured for sliding, starting at one of the top surface and the bottom surface of the first concrete facing panel, into the one of the at least one retaining structure of the first concrete facing panel, and the second base connector is configured for sliding, starting at one of the top surface and the bottom surface of the second concrete facing panel, into the one of the at least one retaining structure of the second concrete facing panel.

3. The method of claim 2, wherein:

the first base connector and its respective retaining structure are configured to pivot with respect to each other when engaged to each other, and the step of engaging the first base connector to its respective retaining structure comprises pivotally engaging the first base connector to its respective retaining structure.

4. The method of claim 3, wherein:

the respective retaining structure is a V-groove, and the step of pivotally engaging the first base connector to its respective retaining structure includes pivotally engaging the first base connector to the V-groove.

5. The method of claim 2, wherein:

the first base connector defines a first opening, the second base connector defines a second opening, the first link end engages the first opening to pivotally connect the first link end to the first base connector, and the second link end engages the second opening to pivotally connect the second link end to the second base connector.

6. The method of claim 1, wherein:

each retaining structure is shaped as a keyhole slot, and the step of connecting comprises inserting the first connecting end and the second connecting end into a respective keyhole slot.

7. The method of claim 1, wherein:

the first connecting end and the second connecting end each have a respective enlargement, and the step of connecting comprises inserting the enlargement of the first connecting end into its respective retaining structure and inserting the enlargement of the second connecting end into its respective retaining structure.

8. The method of claim 7, wherein:

each enlargement defines a respective cylindrical stem, and each retaining structure defines a cylindrical bore extending from the top surface to the bottom surface of the first concrete facing panel or a cylindrical bore extending from the top surface to the bottom surface of the second concrete facing panel, and the step of connecting comprising fittingly engaging the cylindrical stem of the first connecting end and the cylindrical stem of the second connecting end to a respective cylindrical bore.

9. The method of claim 1, further comprising adding a loose filler material in the intermediate space.

10. A wall kit for a double sided hollow wall, the wall kit comprising:

a plurality of monolithic concrete facing panels each having a front surface an opposite back surface, a top surface and bottom surface, the back surface defining at least one retaining structure, each of the at least one retaining structure extending from the top surface to the bottom surface; and a plurality of connectors for connecting the plurality of concrete facing panels in back-to-back, spaced apart parallel rows to form a pair of spaced apart parallel first and second wall components with an intermediate space, the connectors being articulated connectors each having a first connecting end, a second connecting end and a link, the link for forming a pivot joint between the first connecting end and the second connecting end, the first connecting end configured for removably connecting to one of the at least one retaining structure of the first concrete facing panel by sliding, starting at one of the top surface and the bottom surface of the first concrete facing panel, the first connecting end into the one of the at least one retaining structure of the first concrete facing panel, and the second connecting end configured for removably connecting to one of the at least one retaining structure of the second concrete facing panel by sliding, starting at one of the top surface and the bottom surface of the second concrete facing panel, the second connecting end into the one of the at least one retaining structure of the second concrete facing panel.

11. The kit of claim 10, wherein:

the first connecting end has a first base connector, the second connecting end has a second base connector, the link has a first link end and a second link end, the first link end is pivotally connected to the first base connector, and the second link end is pivotally connected to the second base connector.

12. The kit of claim 11, wherein the first base connector and its respective retaining structure are configured to pivot with respect to each other when engaged to each other.

13. The kit of claim 12, wherein the retaining structure is a V-groove.

14. The kit of claim 11, wherein:

the first base connector defines a first opening, the second base connector defines a second opening, the first link end engages the first opening to pivotally connect the first link end to the first base connector, and the second link end engages the second opening to pivotally connect the second link end to the second base connector.

15. The kit of claim 10, wherein each retaining groove is shaped as a keyhole slot.

16. The kit of claim 15, wherein the first connecting end and the second connecting end each have a respective enlargement configured for insertion into a respective keyhole slot.

17. The kit of claim 10, wherein:

the first connecting end and the second connecting end each have a respective enlarged portion that defines a cylindrical stem, and the retaining structures are cylindrical bores each configured for receiving a respective cylindrical stem, the cylindrical bores including at least one of a first cylindrical bore extending from the top surface to the bottom surface of the first concrete facing panel and a second cylindrical bore extending from the top surface to the bottom surface of the second concrete facing panel.

18. A double sided hollow wall, comprising:

a plurality of monolithic concrete facing panels, each concrete facing panel having a front surface, an opposite back surface, a top surface and a bottom surface the opposite back surface defining a retaining structure, the retaining structure extending from the top surface to the bottom surface;

the facing panels being stacked side-by-side and in a spaced apart back to back arrangement for forming back-to-back and spaced apart parallel first and second wall components with an intermediate space; and a plurality of first connectors respectively connecting the retaining structure in a concrete facing panel in the first wall component to the retaining structure in at least one concrete facing panel in the second wall component to form the double sided hollow wall, the connectors being articulated connectors each having a first connecting end, a second connecting end and a link, the link for forming a pivot joint between the first connecting end and the second connecting end, the first connecting end configured for removably connecting to one of the at least one retaining structure of the first concrete facing panel by sliding, starting at one of the top surface and the bottom surface of the first concrete facing panel, the first connecting end into the one of the at least one retaining structure of the first concrete facing panel, and the second connecting end configured for removably connecting to one of the at least one retaining structure of the second concrete facing panel by sliding, starting at one of the top surface and the bottom surface of the second concrete facing panel, the second connecting end into the one of the at least one retaining structure of the second concrete facing panel.

19. The wall of claim 18 wherein:

the first connecting end has a first base connector, the second connecting end has a second base connector, the link has a first link end and a second link end, the first link end is pivotally connected to the first base connector, and the second link end is pivotally connected to the second base connector.

20. The wall of claim 19, wherein the first base connector and its respective retaining structure are configured to pivot with respect to each other when engaged to each other.

21. The wall of claim 20, wherein the retaining structure is a V-groove.

22. The wall of claim 19, wherein:

the first base connector defines a first opening, the second base connector defines a second opening, the first link end engages the first opening to pivotally connect the first link end to the first base connector, the second link end engages the second opening to pivotally connect the second link end to the second base connector.

23. The wall of claim 18, wherein each retaining groove is shaped as a keyhole slot.

24. The wall of claim 18, wherein the first connecting end and the second connecting end each have a respective enlargement configured for insertion into a respective keyhole slot.

25. The wall of claim 18, wherein:

the first connecting end and the second connecting end each have a respective enlarged portion that defines a respective cylindrical stem, and the retaining structures are cylindrical bores each configured for receiving a respective cylindrical stem.

* * * * *